United States Patent [19]

Morand

[11] Patent Number: 5,009,313

[45] Date of Patent: Apr. 23, 1991

[54] BATHROOM TISSUE DISPENSER (SPINDLE RELEASE)

[75] Inventor: Michel Morand, Montreal, Canada

[73] Assignee: Wyant & Company Limited, Lachine, Canada

[21] Appl. No.: 480,590

[22] Filed: Feb. 15, 1990

[30] Foreign Application Priority Data

Aug. 16, 1989 [GB] United Kingdom ..... 8918667

[51] Int. Cl.[5] ..... B65D 85/62

[52] U.S. Cl. ..... 206/391; 206/581; 206/226

[58] Field of Search ..... 206/391, 581, 233, 226, 206/225, 817, 821, 823; 242/55.53

[56] References Cited

U.S. PATENT DOCUMENTS

| | | | |
|---|---|---|---|
| 4,180,192 | 12/1979 | Breslau | 206/391 |
| 4,199,078 | 4/1980 | Ramirez | 206/391 |
| 4,765,475 | 8/1988 | Kaysserian | 206/391 |

*Primary Examiner*—Joseph Man-Fu Moy

*Attorney, Agent, or Firm*—Larson and Taylor

[57] ABSTRACT

A two-roll toilet paper dispenser having a vertical spindle with stop means part way up the spindle. The stop means divides the spindle into a lower portion on which a first toilet paper roll is mounted in an operative position and an upper portion on which a second toilet paper roll is mounted in a storage position. Actuating means are provided for operating the stop means to permit a roll resting thereon in the storage position to drop down the spindle to the operative position.

11 Claims, 2 Drawing Sheets

BATHROOM TISSUE DISPENSER (SPINDLE RELEASE)

This invention is directed toward an improved two-roll toilet paper dispenser.

Two-roll toilet paper dispensers are well known. The dispenser holds one roll in an operative position where it is readily accessible when required while the second roll is held in storage When the first roll is used up, the dispenser is operated to place the second roll in an operative position. Another roll is added to replace the second roll when the dispenser is normally serviced. Thus a user never runs out of toilet paper.

The known two-roll toilet paper dispensers are however, quite complicated in construction, and often difficult to operate in placing the second roll in an operative position. Usually the second roll must be located in a storage area where it is generally inaccessible to the user so that it is not prematurely used. When the first roll is used up, the second roll must be moved to the operative position. The moving mechanism can be quite complicated in construction, even if the second roll is partly moved by gravity, thus making the dispensers costly, and difficult to maintain.

It is therefore the purpose of the present invention to provide an improved two-roll toilet paper dispenser that is relatively simple in construction, and easy to operate to move a roll from a storage position to an operative position.

In accordance with the present invention, there is provided a dispenser having a base on which a vertical spindle is mounted. Stop means are provided on the spindle about half way up its length. A first roll is rotatably mounted on the spindle beneath the stop means in a readily accessible operative position. A second roll is rotatably mounted on the spindle, above the first roll and resting on the stop means, in a somewhat inaccessible storage position. When the first roll is used up, and its core is removed, actuating means can be operated to move the stop means allowing the second roll to drop down on the spindle to the operative position. The actuating means are quite simple in construction and reliable in operation.

The invention is particularly directed toward a two-roll toilet paper dispenser having a base with a bottom support arm and an upper enclosure. A spindle extends up from the bottom support arm into the enclosure. Stop means are provided on the spindle positioned to have space for a first toilet paper roll, consisting of a coil of paper wrapped on a core, rotatably mounted on the spindle and resting on the support arm beneath the stop means in a lower operative position. The stop means are also positioned on the spindle to have space for a second toilet paper roll, consisting of a coil of paper wrapped on a core, rotatably mounted on the spindle and resting on the stop means substantially enclosed by the enclosure in an upper storage position. Actuating means move the stop means to allow the second roll to drop on the spindle from the storage position to the operating position when the paper coil of the first roll has been used up and its core removed.

The invention will now be described in detail having reference to the accompanying drawings in which.

Figures 1, 2, 3, 4:
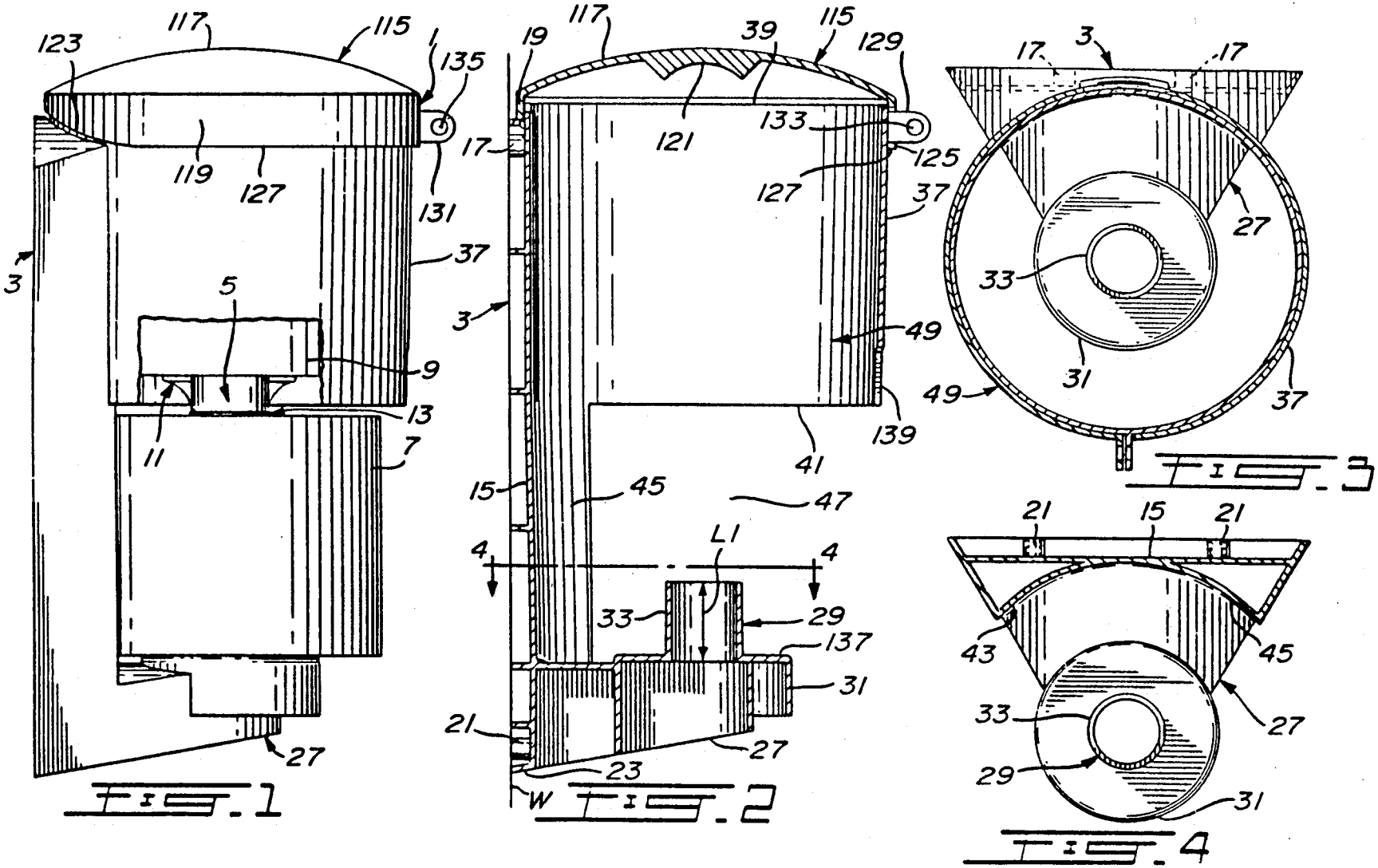
FIG. 1 is a side view of the dispenser.
FIG. 2 is a cross-section view of the base of the dispenser.
FIG. 3 is a top view of the base.
FIG. 4 is a cross-section view taken along line 4—4 of FIG. 2.

The two-roll dispenser 1 as shown in FIG. 1 comprises a base 3 and spindle means 5 mounted on the base 3 for holding two rolls 7, 9 of toilet paper one above the other. Each roll of toilet paper comprises a coil of paper wrapped on a core as is well known. The bottom roll 7 is held on the spindle means 5 in a lower operative position in the base where it is readily accessible so that toilet paper can be pulled off the roll when needed. The top roll 9 is held on stop means 11 on the spindle means 5 is an upper storage position in the base above the bottom roll 7. In the upper storage position, the top roll 9 is substantially enclosed so that it is not likely to be used while there is toilet paper on the bottom roll 7. When the toilet paper is used up from the bottom roll 7, its empty core is ripped off the spindle means 5 and actuating means 13 are actuated on the spindle means 5 to move the stop means 11 so as to drop the top roll 9 to the lower operative position. Maintenance personnel can place a new roll in the upper storage position at their convenience.

In more detail, the base 3 of the dispenser 1 as shown in FIGS. 2, 3 and 4 has a back wall 15 by means of which the dispenser is mounted against a wall "W". the back wall 15 has fastener openings 17 adjacent its top edge 19 and fastener openings 21 adjacent its bottom edge 23 through which fasteners (not shown) are used to mount the base. A lower support arm 27 extends outwardly form the back wall 15 adjacent its bottom edge 23. The support arm 27 carries a mounting member 29 near its outer end 31 for receiving the spindle means 5. The mounting member 29 is in the form of a short tube 33.

A tubular enclosure 37 is mounted on the upper part of the back wall 15. The enclosure 37 is centered over the mounting tube 33 and is open at its top and bottom ends 39, 41. Narrow, curved sidewalls 43, 45 can extend from each side of the back wall 15 between the support arm 27 and enclosure 37. The open space 47 between the support arm 27 and enclosure 37 in front of the back wall 15 defines the lower operative position for a toilet paper roll in this location. A toilet paper roll in this position is partially enclosed by the sidewalls 43, 45 but is still readily accessible to have toilet paper taken off it. The closed space 49 within the enclosure 37, above open space 47, defines the upper storage position for a toilet paper roll in this location. A toilet paper roll in this position is substantially enclosed and hidden from view and will not likely be used until the lower roll is used up.

Figure 5:
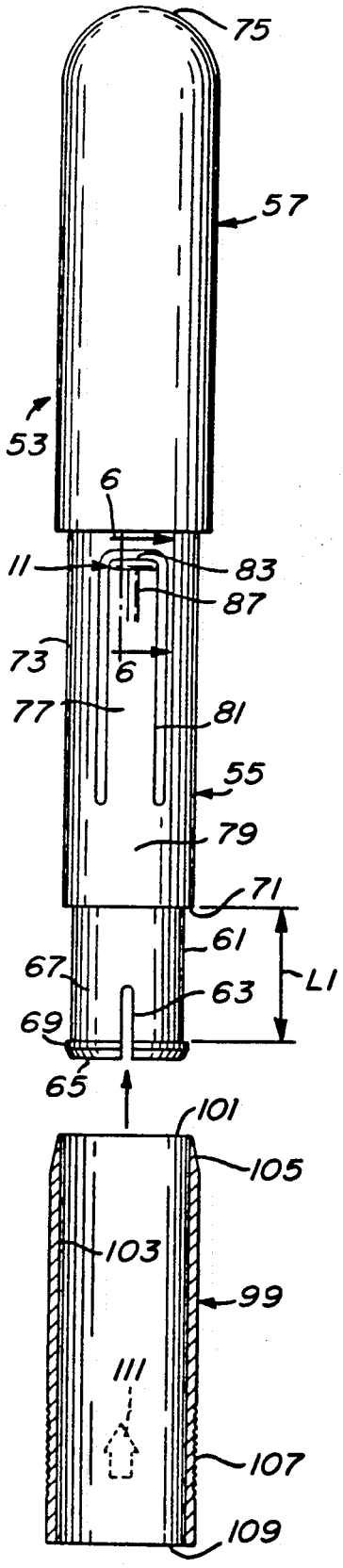
FIG. 5 is a exploded view of the spindle means.
Figure 6:
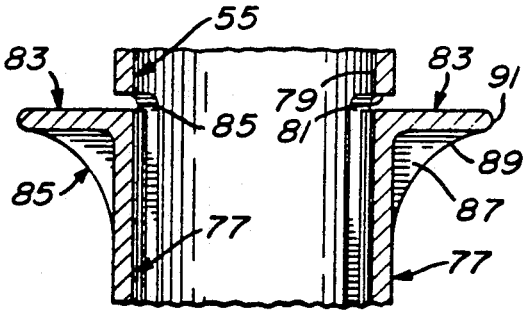
FIG. 6 is a detail cross-section view of the spindle means taken along line 6—6 in FIG. 5.

The spindle means 5 as shown in FIGS. 5 and 6 comprises a hollow spindle 53 having a lower spindle section 55 and an upper spindle section 57. The lower spindle section 55 has a tubular bottom portion 61 with slots 63 extending partway up the bottom portion from its bottom end 65. The slots 63 extend parallel to the longitudinal axis of the spindle means 5 and divide the lower part of the bottom portion 61 into resilient arms 67. A flange 69 is provided about the bottom portion 61 adjacent its bottom end 65. The length L1 between the flange 69 and the shoulder 71 defining the top end of the bottom portion 61, is equal to the length L1 of the mounting tube 33.

The lower spindle section 55 includes a relatively long tubular, upper portion 73. The upper portion 73 has a slightly larger diameter than the bottom portion 61. The upper spindle section 57 comprises a relatively long tubular portion forming an extension of the long upper portion 73 of the lower spindle section 55. The upper spindle section 57 can have a diameter slightly greater than the diameter of the upper portion 73 of the lower spindle section 55. The top end 75 of the upper spindle section 57 can be rounded.

Figure 8:
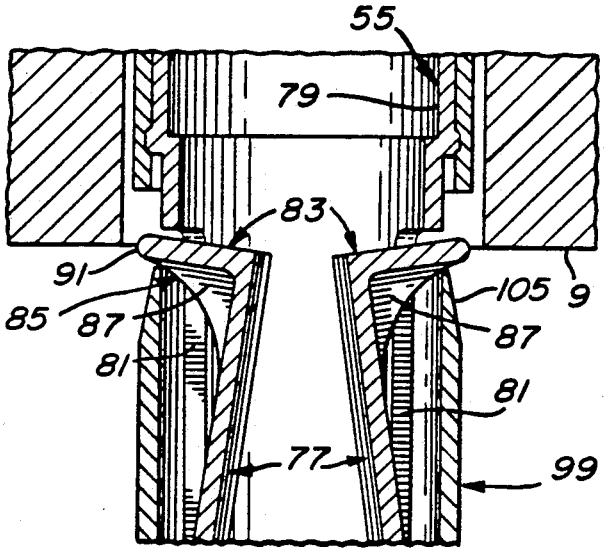
FIG. 8 is a detail cross-section view showing the operation of the sleeve to drop the top roll.

The stop means 11 are mounted on the lower spindle section 55. The stop means 11 have opposed, elongated, resilient fingers 77 formed in the cylindrical wall 79 of the upper portion 73. Each finger 77 is defined by an elongated, inverted, U-shaped slot 81 in the wall 79 as shown in FIGS. 5, 6 and 8. Each finger 77 extends upwardly and has a stop member 83 extending laterally outwardly from its upper end. The stop members 83 can move laterally relative to the longitudinal axis of the spindle means 5, moving substantially within the tubular upper portion 73 of the lower spindle section 55. The stop members 83 normally support the top roll 9 in an upper storage position as will be described.

The actuating means 13 include cam means 85 provided on the stop means 11. The cam means 85 comprise a curved cam 87 in the form of a web that connects between each stop member 83 and its associated finger 81. The curved cam surface 89 on the cam 87 extends between the outer surface of the finger 81 and the outer end 91 of the stop member 83.

The actuating means 13 also includes a spindle sleeve 99 that is slidably and rotatably mounted on the lower spindle section 55. The spindle sleeve 99 comprises a tubular member having an upper end 101 with the wall 103 of the member tapering inwardly to the upper end 101 and shown at 105. The outer surface of the member can have a roughened area 107 near its bottom end 109 allowing it to be more easily gripped. Upwardly pointing arrows 111 can be molded or printed on the outer surface of the sleeve.

The dispenser 1 is provided with a removable cover 115 to close the top end 39 of the tubular enclosure 37. The cover, as shown in FIGS. 1 and 2, can comprise a domed circular portion 117 and a tubular skirt portion 119 the top end 75 of the spindle 53 snugly projects. The skirt portion 119 of the cover 115 fits snugly about the upper portion of the enclosure 37. The skirt portion 119 can have a cutout 123 at the rear to accommodate base 3. A slot 125 is provided at the front of the skirt portion 119 extending up from its free edge 127. The slot 125 receives a flange 129 extending radially out from the tubular enclosure 37 adjacent its top end 39. A flange 131 also extends radially out from the skirt portion 119 adjacent slot 125. With the cover 115 mounted over the enclosure 37, the flange 131 on the cover 115 is adjacent the flange 129 on the enclosure 37, and holes 133, 135 on the flanges 129, 131 respectively are aligned. A lock (not shown) passed through the aligned holes 133, 135 locks the cover 115 to the enclosure 37. The cover 115 helps strengthen the dispenser 1, particularly the spindle means 5, since it is now securely held top and bottom. The cover also prevents theft or improper use of the top paper coil, and minimizes vandalism of the dispenser. The cover and locking means can take forms other than those described above.

Figure 7:
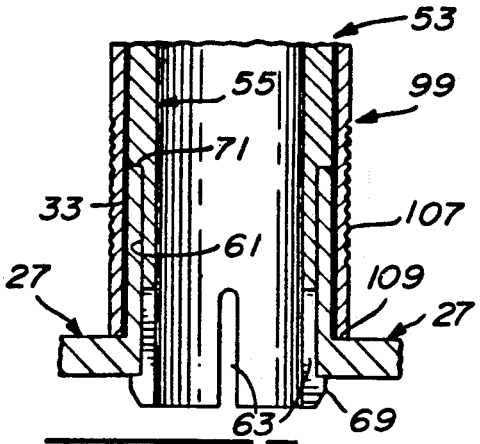
FIG. 7 is a detail cross-section view showing the mounting of the spindle means onto the base.

The dispenser 1 is assembled by securing the spindle means 5 in a vertical position on the support arm 27 of the base 3. The sleeve 99 is slid over the lower part of the lower spindle section 55 of the spindle 53 and then the bottom portion 61 of the lower spindle section 55 is inserted into the mounting tube 33 as shown in FIG. 7. The resilient arms 67 on the bottom portion 61 flex inwardly as the spindle is pushed through the tube 33. Once the flange 69 passes through the tube 33, the arms 67 move back out and the spindle 53 is securely locked in the tube 33 between flange 69 and shoulder 71. The assembled dispenser 1 can then be mounted on the wall "W".

The dispenser 1 is initially loaded, with the cover 115 removed, with two toilet paper rolls. The first roll 7 is dropped down over the top end 75 of the spindle 53 through the open top end 39 of the enclosure 37. The first roll comes to rest on the stop members 83 of the stop means 11 on the spindle 53 in the upper storage position. The actuating means 11 are then operated to cause the roll 7 to drop down to the lower operative position. The actuating means 11 comprise the spindle sleeve 99 and the cam means 85 on the resilient fingers 81 carrying the stop members 83. The spindle sleeve 99 is grasped and manually moved upwardly on the lower spindle section 55, its upper end 101 contacting the cams 87 on the fingers 81 and moving the fingers 81 inwardly. As the stop members 83 move inwardly clear of the bottom of the first roll as shown in FIG. 8, the roll drops down over the sleeve 99. The sleeve is lowered allowing the fingers 81 and stop members 83 to return to their normal position and the first roll moves down to rest on the support arm 137, freely rotatable about the sleeve 99 in the lower operative position A second roll is dropped down over the spindle to rest on the stop members 83 in the upper storage position The cover 115 is then replaced. When the first roll is used up, its core is torn away from the spindle means 5 and the actuating means 11 is again operated as suggested by the arrows 111 on the sleeve 99 to drop the second roll down to the lower operative position. An opening 139 may be provided in the enclosure 37 to permit a visual check of the second roll in the upper storage position. Maintenance personnel can replace this second roll with another roll at their convenience.

I claim:

1. A two-roll toilet paper dispenser having a base with a bottom support arm and an upper enclosure; a spindle extending up from the bottom support arm into the enclosure; movable stop means provided on the spindle and positioned thereon to have space for a first toilet paper roll, consisting of a coil of paper wrapped on a core, rotatably mounted on the spindle and resting on the support arm beneath the stop means in a lower operative position; the stop means also positioned on the spindle to provide space for a second toilet paper roll, consisting of a coil of paper wrapped on a core, rotatably mounted on the spindle and resting on the stop means substantially enclosed by the enclosure in an upper storage position, and actuating means on the dispenser to move the stop means to permit the second roll to drop on the spindle from the storage position to the operating position when the paper coil of the first roll has been used up and its core removed.

2. A two-roll toilet paper dispenser having a base with a bottom support arm and an upper enclosure; a spindle extending up from the bottom support arm into the enclosure; stop means provided on the spindle and positioned thereon to have space for a first toilet paper roll, consisting of a coil of paper wrapped on a core, rotatably mounted on the spindle and resting on the support arm beneath the stop means in a lower operative position; the stop means also positioned on the spindle to provide space for a second toilet paper roll, consisting of a coil of paper wrapped on a core, rotatably mounted on the spindle and resting on the stop means substantially enclosed by the enclosure in an upper storage position, and actuating means to move the stop means to permit the second roll to drop in the spindle from the storage position to the operating position when the paper coil of the first roll has been used up and its core removed, wherein the actuating means includes a sleeve rotatably and slidably mounted on the spindle below the stop means, the first toilet paper roll rotatably mounted about the sleeve on the spindle.

3. A dispenser as claimed in claim 2 wherein the actuating means includes cam means on the stop means, the cam means located in the path of sliding movement of the sleeve whereby when the sleeve is raised, its leading end contacts the cam means to move the stop means in a manner permitting the second roll, normally resting on the stop means, to drop down about the sleeve on the spindle.

4. A two-roll toilet paper dispenser having a base with a bottom support arm and an upper enclosure; a spindle extending up from the bottom support arm into the enclosure; wherein the spindle is hollow with a cylindrical wall, stop means provided on the spindle and positioned thereon to have space for a first toilet paper roll, consisting of a coil of paper wrapped on a core, rotatably mounted on the spindle and resting on the support arm beneath the stop means in a lower operative position; the stop means also positioned on the spindle to provide space for a second toilet paper roll, consisting of a coil of paper wrapped on a core, rotatably mounted on the spindle and resting on the stop means substantially enclosed by the enclosure in an upper storage position, the stop means comprising a pair of opposed, longitudinal extending, resilient fingers formed in the wall of the spindle, the fingers extending upwardly, each finger terminating in a stop member that extends transversely from the finger and the spindle; and actuating means to move the stop means to permit the second roll to drop on the spindle from the storage position to the operating position when the paper coil of the first roll has been used up and its core removed.

5. A dispenser as claimed in claim 4 wherein the actuating means includes a sleeve rotatable and slidably mounted on the spindle below the stop means, the first toilet paper roll rotatably mounted about the sleeve on the spindle.

6. A dispenser as claimed in claim 5 wherein the actuating means includes cam means on the stop means located between each finger and its stop member, the cam means located in the path of sliding movement of sleeve, whereby when the sleeve is raised, its leading end contacts the cam means to move the stop members and their attached resilient fingers inwardly into the spindle permitting the second roll, normally resting on the stop members, to drop down about the sleeve on the spindle.

7. A two-roll toilet paper dispenser having a base with a bottom support arm and an upper enclosure; a spindle extending up from the bottom support arm into the enclosure; stop means provided on the spindle and positioned thereon to have space for a first toilet paper roll, consisting of a coil of paper wrapped on a core, rotatably mounted on the spindle and resting on the support arm beneath the stop means in a lower operative position; the stop means also positioned on the spindle to provide space for a second toilet paper roll, consisting of a coil of paper wrapped on a core, rotatably mounted on the spindle and resting on the stop means substantially enclosed by the enclosure in an upper storage position, wherein the stop means are mounted for lateral movement relative to the longitudinal axis of the spindle; and actuating means to move the sop means to permit the second roll to drop on the spindle from the storage position to the operating position when the paper coil of the first roll has been used up and its core removed.

8. A dispenser as claimed in claim 7 including resilient means on the stop means for returning the stop means to their operative, second toilet paper roll supporting position when moved laterally.

9. A dispenser as claimed in claim 8 wherein the actuating means includes a sleeve rotatably and slidably mounted on the spindle below the stop means, the first toilet paper roll rotatably mounted about the sleeve on the spindle.

10. A dispenser as claimed in claim 9 wherein the actuating means includes cam means on the stop means, the cam means located in the path of sliding movement of the sleeve whereby when the sleeve is raised, its leading end contacts the cam means to move the stop means laterally away from the second roll which is normally resting on the stop means thereby permitting the second roll to drop down about the sleeve on the spindle.

11. A dispenser as claimed in claims 2, wherein the leading end of the sleeve is tapered.

* * * * *